US008943828B2

(12) United States Patent
Bagchi et al.

(10) Patent No.: US 8,943,828 B2
(45) Date of Patent: Feb. 3, 2015

(54) LEAN PREMIX BURNER OF A GAS-TURBINE ENGINE PROVIDED WITH A CONCENTRIC ANNULAR CENTRAL BODY

(75) Inventors: Imon-Kalyan Bagchi, Berlin (DE); Waldemar Lazik, Teltow (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 933 days.

(21) Appl. No.: 13/098,610

(22) Filed: May 2, 2011

(65) Prior Publication Data

US 2011/0271680 A1 Nov. 10, 2011

(30) Foreign Application Priority Data

May 7, 2010 (DE) ..... 10 2010 019 772

(51) Int. Cl.
*F23R 3/28* (2006.01)
*F23R 3/14* (2006.01)

(52) U.S. Cl.
CPC .... *F23R 3/28* (2013.01); *F23R 3/14* (2013.01)
USPC ..... 60/737; 60/743

(58) Field of Classification Search
CPC ..... F23R 3/28–3/30; F23R 3/14; F23D 2900/11101
USPC ..... 60/737, 748, 740, 743
See application file for complete search history.

(56) References Cited

U.S. PATENT DOCUMENTS

| | | | | |
|---|---|---|---|---|
| 5,329,760 | A | 7/1994 | Bradley | |
| 7,506,510 | B2 | 3/2009 | Thomson | |
| 7,658,075 | B2 | 2/2010 | Von Der Bank | |
| 7,669,420 | B2 * | 3/2010 | Spooner | 60/743 |
| 7,926,744 | B2 * | 4/2011 | Thomson et al. | 60/743 |
| 2006/0021350 | A1 * | 2/2006 | Sanders | 60/743 |
| 2007/0028619 | A1 | 2/2007 | Spooner | |
| 2007/0137207 | A1 | 6/2007 | Mancini et al. | |
| 2007/0163263 | A1 | 7/2007 | Thomson | |
| 2007/0289306 | A1 | 12/2007 | Suria et al. | |
| 2008/0302105 | A1 | 12/2008 | Oda | |

FOREIGN PATENT DOCUMENTS

| | | |
|---|---|---|
| CA | 976376 | 10/1975 |
| EP | 1413830 | 4/2004 |

* cited by examiner

*Primary Examiner* — Ted Kim
(74) *Attorney, Agent, or Firm* — Timothy J. Klima; Shuttleworth & Ingersoll, PLC

(57) ABSTRACT

This invention relates to a lean premix burner of a gas-turbine engine with an annular central body 2, which, while being essentially concentric to a burner center axis 1, is provided with an annular duct 4 connected to a supply line 3 and with a film applicator 5 which conically widens at the fuel exit side and into whose radially inward area at least one fuel exit opening 6 issues which is connected to the annular duct, characterized in that the film applicator 5 has, adjacently to and downstream of the fuel exit openings 6 in the area facing the fuel exit side 8, a step-like, annular protruding area 7 disposed radially to the burner center axis.

7 Claims, 3 Drawing Sheets

Figure 1:
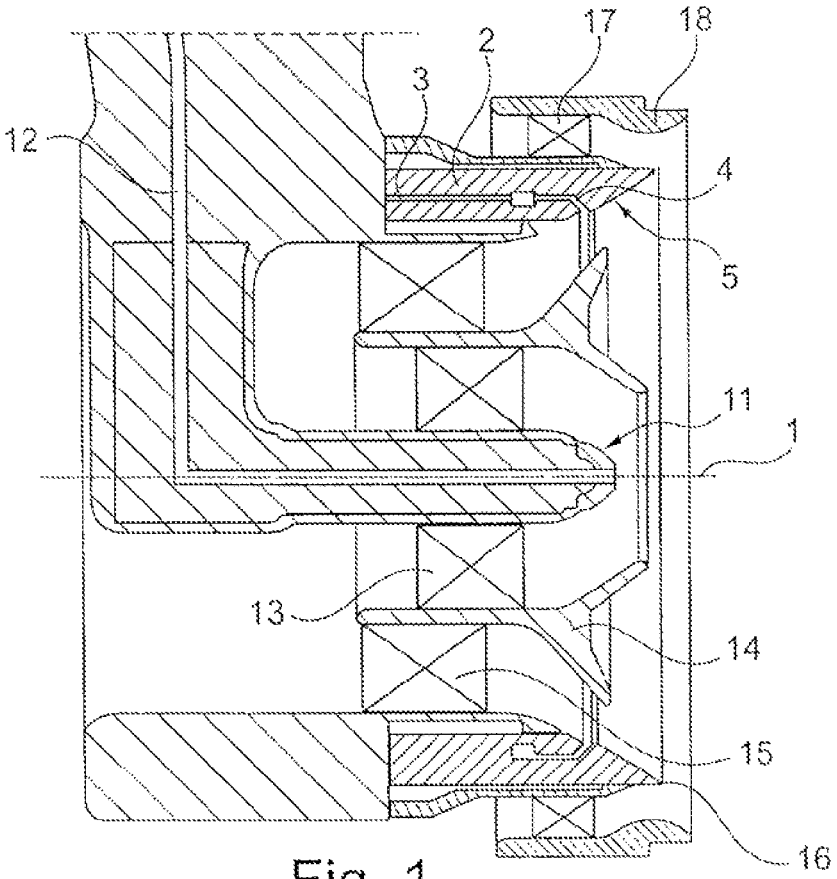

LEAN PREMIX BURNER OF A GAS-TURBINE ENGINE PROVIDED WITH A CONCENTRIC ANNULAR CENTRAL BODY

The present invention relates to a lean premix burner of a gas-turbine engine.

More particularly, the present invention relates to a lean premix burner of a gas-turbine engine with an annular central body which, while being essentially concentric to a burner centre axis, is provided with an annular duct connected to a supply line and with a film applicator which conically widens at the fuel exit side and into whose radially inward area at least one fuel exit opening issues which is connected to the annular duct.

Combustion chambers of gas-turbine engines can be provided with lean premix burners in order to enable a fuel-air mixture with high content of air to be burned in the combustion chamber at low combustion temperature and with correspondingly reduced formation of nitrogen oxide. In order to ensure ignition of the lean air-fuel mixture under any condition, for example also at low ambient temperatures and correspondingly adverse vaporization behaviour, it is known to combine the lean burner (main burner) with a supporting burner, which is centrally integrated into the latter.

Furthermore, burners with an atomizer lip—also known as film applicator—are known, for example from Specification U.S. Pat. No. 6,560,964 B2. The annular atomizer lip, on which a continuous fuel film is generated, with the fuel film being acted upon by a concentric airflow, significantly enhances the atomization effect and the mixing of fuel and air.

Such burners can be provided with an annular atomizer lip having a circumferential fuel film application surface, as described in Specification EP 1 801 504, for example. A continuous fuel film is applied to the film application surface—uniformly distributed by supply ducts issuing at the film application surface—which is acted upon by a concentric airflow caused to swirl by swirler elements. This enables high atomization effect and intense mixture of air and fuel to be obtained.

However, as the film application surface is usually smooth, positive attachment of the fuel film is not fully ensured, especially if fuel mass flows are low, i.e. the airflow, and thus the fuel film, may separate from the film application surface, in particular if the flow at the atomizer lip is retarded, i.e. has concave flow lines. This results in non-uniform, circumferentially streak or point-type fuel distribution. Moreover, separation of the flow and the fuel film from the film application surface of the atomizer lip will lead to turbulent instabilities which may give rise to compressive oscillations of high amplitude.

In a broad aspect, the present invention provides a design of a lean premix burner of the type mentioned at the beginning such that a stable, uniformly distributed fuel film is produced at the film application surface, which detaches uniformly at the flow-off edge and forms a fine droplet mist to ensure quiet and uniform combustion at low temperature, low nitrogen oxide formation and good combustion efficiency.

It is a particular object of the present invention to provide solution to the above problems by a combination of the features described herein. Advantageous embodiments of the present invention become apparent from the present description.

The present invention therefore provides that the film applicator has, adjacently to the fuel exit openings in the area facing the fuel exit side, a step-like, annular protruding area disposed radially to the burner centre axis. This protruding area can have the shape of a circular ring, so that, at the fuel exit, a step is formed in the flow streaming along the film applicator on its fuel exit side. Thus, the flow along the surface is influenced such that it is accelerated at said positive step, or this positive protrusion, as a result of which the fuel will contact airflow areas with increased velocity. This results in more favourable boundary layer effects, leading to a more uniform and more stable fuel distribution. The improved atomization resulting therefrom in turn leads to better combustion. The present invention accordingly provides for more homogenous fuel input and better pre-mixing. These two effects provide for optimized combustion with improved NOx, CO and UHC values.

The present invention permits a continuous fuel film to be applied to the film application surface even with increasing diameters of film applicators and low fuel mass flows. The improved combustion through the burner resulting therefrom has considerable advantages, in particular at medium thrust settings of the gas-turbine engine.

In a particularly favourable embodiment it is provided that the protruding area is also cone-shaped and therefore preferably has a cone angle which is equal to the remaining conical area of the film applicator upstream of the protruding area.

In a particularly favourable development of the present invention, it is further provided that the step-like protruding area is rounded. Thus, the fuel issuing from the fuel exit opening is passed smoothly around the rounded edge of the protruding area. This in turn is beneficial to film formation and subsequent atomization.

It is furthermore favourable if the film applicator surface disposed downstream of the fuel exit opening is provided with a roughened surface. This roughened surface can be produced by sandblasted areas, incorporated recesses, slots or grooves. The roughened surface results in an improved contact angle for liquid drops applied to the surface. Thus, the wettability of the surface is improved due to the resultant, more favourable surface tensions which, via Young's equation, are related to the contact angle, making the latter the measure for wettability. The smaller the contact angle, the greater the wettability of the film applicator surface by fuel. Owing to these measures, streak formation is counteracted and a continuous fuel film provided.

Furthermore, it can be particularly favourable in accordance with the present invention if slots and/or grooves are incorporated in planes vertical to the burner centre axis downstream of the fuel distribution along the film applicator. These also provide for improved boundary layer characteristics of the flow and, thus, improved fuel output.

Figure 2:
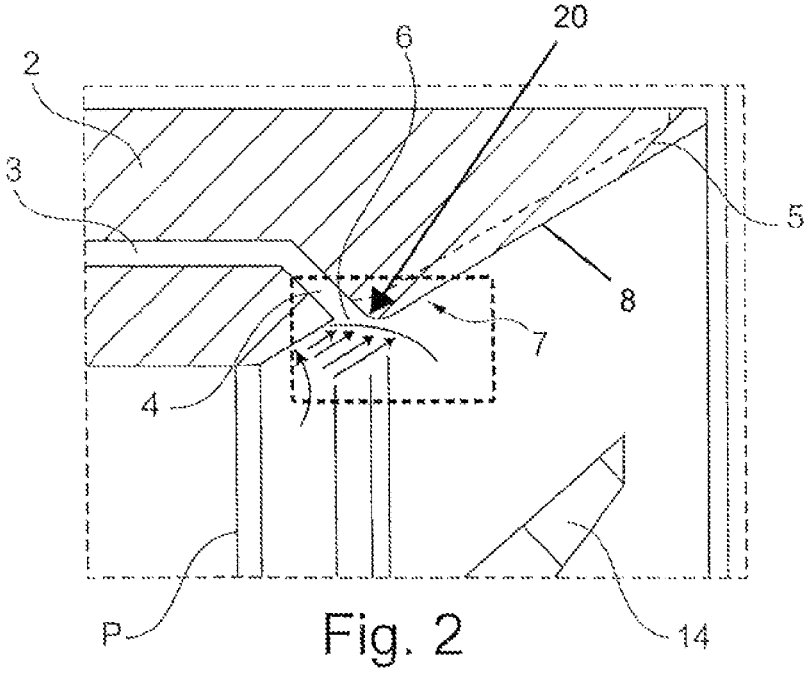
Figure 3:
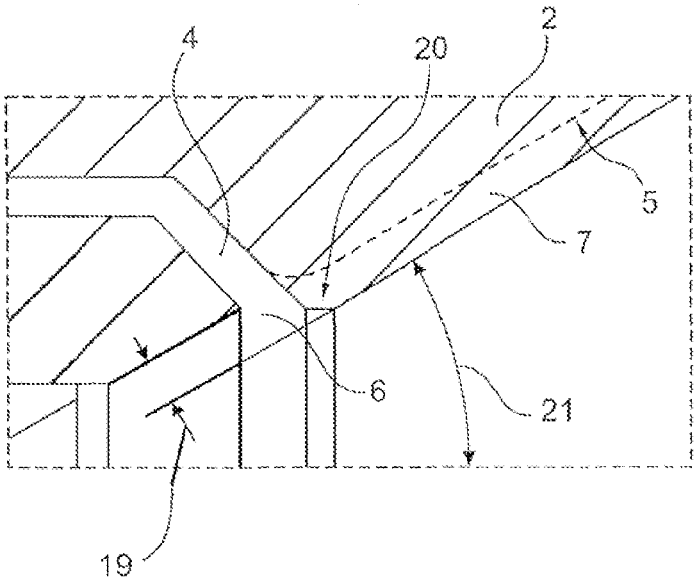
Figure 4:
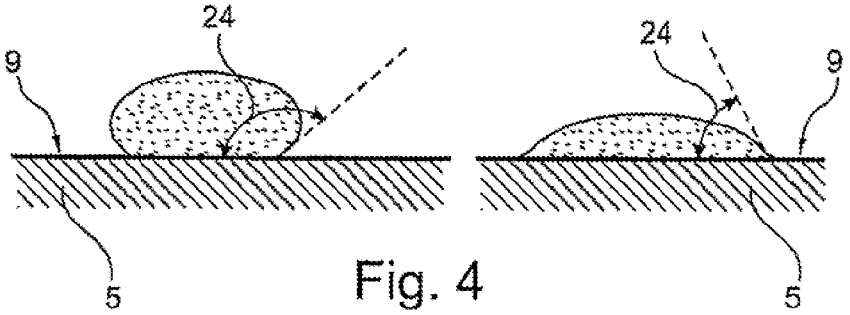
Figure 5:
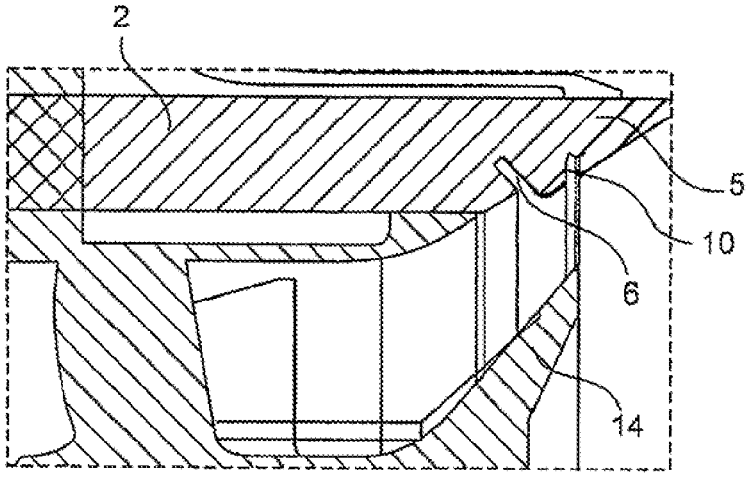
Figure 6:
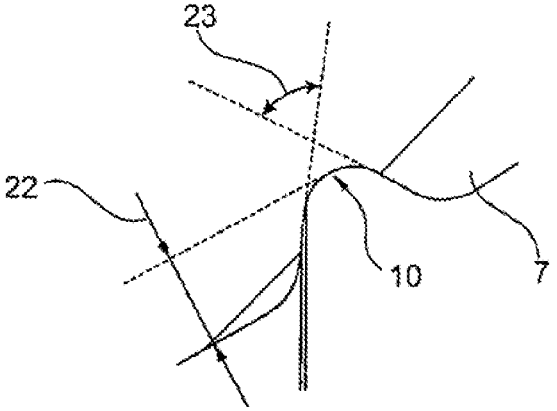

The present invention is more fully described in light of the accompanying drawing showing preferred embodiments. In the drawing, FIG. 1 is a schematic sectional view of a lean premix burner with the film applicator designed in accordance with the present invention, FIG. 2 is an enlarged detail view of the exemplary embodiment shown in FIG. 1, FIG. 3 shows an enlarged detail as per FIG. 2, FIG. 4 provides two detail views for representing the contact angle of the surface, FIG. 5 shows another design variant, analogically to FIG. 2, and FIG. 6 is an enlarged detail representation as per FIG. 5.

The lean pre-mix burner shown in FIG. 1 has a burner centre axis 1 relative to which the components are essentially concentrically arranged. The lean pre-mix burner features a supporting burner 11 which corresponds to the state of the art and to which fuel is supplied via a fuel line 12. The supporting burner 11 is surrounded by swirler elements 13, as known from the state of the art. Disposed centrically to the supporting burner 11 is a flame stabilizer 14 which again corresponds to the state of the art so that a detailed description can here be dispensed with. Also, at least one swirler element 15 is arranged radially outside of the flame stabilizer 14. Radially outside of the swirler element 15 and concentrically to the burner centre axis 1, the lean pre-mix burner according to the present invention has an annular central body 2 in which a supply line 3 for fuel is provided. The supply line 3 issues into an annular duct 4 enabling fuel to issue through at least one fuel exit opening 6 (also refer to FIG. 3).

The annular central body 2 forms a cone-shaped film applicator 5 widening radially outwards in the direction of flow. Showing radially inwards, a film application surface axially terminating at an atomizer lip 16 is provided on the film applicator 5.

Arranged radially outside of the film applicator 5 or, respectively, the annular central body 2 is at least one swirler element 17 which is radially outwards confined by an outer ring 18.

According to the present invention, a protruding area 7 is provided adjacent to the fuel exit opening 6 on the film applicator 5 (see FIGS. 2 and 3). This protruding area 7 accordingly forms, adjacently to the fuel exit opening 6, a step rounded at its inflow area by which the flow is accelerated, as indicated by the flow arrows in FIG. 2. The protruding area 7 is accordingly part of a fuel exit side 8 of the film applicator 5. The protruding area 7 is also cone-shaped, as shown in FIGS. 2 and 3, in particular. Conicity has the same cone angle as the fuel exit side 8 of the film applicator 5. Thus, an offset 19 is formed which results in a decrease in diameter.

As shown in FIG. 2, the inflow area 20 of the edge or step formed by the protruding area 7 is rounded, resulting in optimized flow.

FIG. 3 further shows a cone angle 21 of the protruding area 7 which is equal to the cone angle upstream of the fuel exit openings.

FIG. 5 shows a modified exemplary embodiment in which an additional slot 10 or groove is provided downstream of the fuel exit openings which is situated in a plane vertical to the burner centre axis 1 and provides for further stabilization of the fuel film.

FIG. 6 shows an enlarged detail of the representation of FIG. 5. Here, reference numeral 22 indicates the slot depth measured vertically to the surface. Reference numeral 23 indicates the flank angle of slot 10.

FIG. 4 shows on the right-hand side a surface 9 of the film applicator 5 according to the present invention, while the left-hand half of FIG. 4 represents a smooth surface according to the state of the art.

FIG. 5 shows that an optimized contact angle 24 can be achieved by roughening the surface 9, leading to improved wetting of the surface of the film applicator 5 with fuel. This is a measure which considerably enhances the effect of the protruding area 7 since fuel issuing from the fuel exit opening and passing over the rounded edge of the inflow area 20 of the protruding area 7 will flow in a more uniform, thinner layer along the surface 9 of the film applicator 5 without streaking occurring.

LIST OF REFERENCE NUMERALS

1 Burner centre axis
2 Annular central body
3 Supply line
4 Annular duct
5 Film applicator
6 Fuel exit opening
7 Protruding area
8 Fuel exit side
9 Surface
10 Slot/groove
11 Supporting burner
12 Fuel line
13 Swirler element
14 Flame stabilizer
15 Swirler element
16 Atomizer lip
17 Swirler element
18 Outer ring
19 Offset
20 Inflow area
21 Cone angle
22 Slot depth
23 Slot angle
24 Contact angle

What is claimed is:

1. A lean premix burner of a gas-turbine engine comprising:

an annular central body being essentially concentric to a burner center axis and including an annular duct connected to a supply line, a film applicator conically widening toward a fuel exit side, and at least one fuel exit opening connected to the annular duct and issuing into a radially inward area of the film applicator, wherein the film applicator includes a step-like, annular protruding area adjacent to and downstream of the at least one fuel exit opening toward the fuel exit side, the protruding area protruding radially toward the burner center axis;

wherein the protruding area is cone-shaped;

wherein the protruding area has a cone angle which is equal to an angle of a conical area of the film applicator upstream of the at least one fuel exit opening;

wherein an inflow area of the protruding area is rounded.

2. The lean premix burner in accordance with claim 1, wherein at least a portion of a surface of the film applicator disposed downstream of the fuel exit opening includes a roughened surface.

3. The lean premix burner in accordance with claim 2, wherein the portion of a surface of the film applicator disposed downstream of the fuel exit opening includes at least one chosen from a groove, a slot, a sandblasted area, and a recess.

4. The lean premix burner in accordance with claim 3, wherein the at least one chosen from a groove and a slot is positioned in a plane vertical to the burner center axis.

5. The lean premix burner in accordance with claim 1, wherein at least a portion of a surface of the film applicator disposed downstream of the fuel exit opening includes a roughened surface.

6. The lean premix burner in accordance with claim 5, wherein the portion of a surface of the film applicator disposed downstream of the fuel exit opening includes at least one chosen from a groove, a slot, a sandblasted area, and a recess.

7. The lean premix burner in accordance with claim 6, wherein the at least one chosen from a groove and a slot is positioned in a plane vertical to the burner center axis.

* * * * *